US006269989B1

(12) United States Patent
Kiselik

(10) Patent No.: US 6,269,989 B1
(45) Date of Patent: Aug. 7, 2001

(54) GARMENT HANGER SHOULDER GUARD

(76) Inventor: Daniel R. Kiselik, P.O. Box 266, Leonia, NJ (US) 07605-0266

( * ) Notice: Subject to any disclaimer, the term of this patent is extended or adjusted under 35 U.S.C. 154(b) by 0 days.

(21) Appl. No.: 09/699,905

(22) Filed: Oct. 30, 2000

(51) Int. Cl.[7] ..... A47G 25/14
(52) U.S. Cl. ..... 223/87
(58) Field of Search ..... 223/85, 92, 87, 223/98

(56) References Cited

U.S. PATENT DOCUMENTS

| | | | | |
|---|---|---|---|---|
| 1,850,169 | * | 3/1932 | De Fay | 223/87 |
| 2,008,365 | | 7/1935 | Oldham . | |
| 2,106,947 | | 2/1938 | Hamilton et al. . | |
| 2,123,369 | | 7/1938 | Luecke . | |
| 2,434,461 | | 1/1948 | Forcheimer . | |
| 2,581,631 | | 1/1952 | Carta . | |
| 2,725,165 | | 11/1955 | Ohlerich . | |
| 2,841,316 | * | 7/1958 | Johnson | 223/87 |
| 3,037,676 | | 6/1962 | Tillery et al. . | |
| 4,066,193 | | 1/1978 | Davis, Jr. . | |
| 5,927,572 | | 7/1999 | Kiselik . | |

* cited by examiner

*Primary Examiner*—Bibhu Mohanty
(74) *Attorney, Agent, or Firm*—Arthur Jacob

(57) ABSTRACT

A garment hanger shoulder guard has an elongate overall configuration with a central portion, a coupling member at each end of the shoulder guard and shoulder support portions intermediate the ends of the shoulder guard. The coupling members each have an end wall connected to a corresponding shoulder support portion by a gusset and fold lines which enable the coupling members and the shoulder guard to be flattened for shipping and storage and erected in the field for assembly with a garment hanger without requiring supplemental operations, such as on-site stapling or manual interlocking of a tab-and-slot assembly. The gussets and fold lines make use of the resilient characteristics of the material of the shoulder guard for facilitating retention of the coupling members securely coupled with the garment hanger when the coupling members and the shoulder guard are erect, and for maintaining a desired garment-supporting contour configuration in the erect shoulder guard upon hanging a garment on the garment hanger.

19 Claims, 5 Drawing Sheets

GARMENT HANGER SHOULDER GUARD

The present invention relates generally to the preservation of desired contours in garments stored and transported on garment hangers and pertains, more specifically, to shoulder guards placed upon garment hangers to protect against unwanted distortion of garments hung on the garment hangers.

By virtue of the versatility and economy provided by garment hangers constructed of wire, the use of wire garment hangers has become widespread in the storage and transport of various garments. Because of the relatively small gage of the wire used in such garment hangers, convention has dictated the use of supplemental supports in connection with the garment hangers for supporting the shoulders of garments hung on the hangers so as to protect against unwanted distortion and creasing and thereby preserve the desired contours of the hung garments while stored and transported on the garment hangers.

As a result, numerous shoulder guard constructions have been proposed and used in connection with garment hangers. The most commonly available shoulder guards are constructed of relatively inexpensive material, such as card stock, which provides sufficient strength and resiliency for the task to be performed, while enabling economy for encouraging widespread use and allowing for expendability.

The present invention provides a shoulder guard which constitutes a departure from current shoulder guard configurations, enabling economy with increased ease of handling and use, and better overall performance characteristics. As such, the present invention attains several objects and advantages, some of which are summarized as follows: Enables increased economy through the use of minimal amounts of material and less waste, as a result of an overall configuration which allows such economical construction; allows economical storage and transportation in a flattened condition with ease of erection and assembly with a garment hanger at the site of use; resists inadvertent removal from a garment hanger, once assembled, so as to provide exemplary performance during both storage and transport of the garment hung on the garment hanger; accommodates variations in dimensions and configuration of garment hangers encountered in the field without sacrificing performance; enables quick and simple erection and assembly at the site of use; provides increased versatility, with economy and exemplary performance in the preservation of desired contours in garments hung on garment hangers.

The above objects and advantages, as well as further objects and advantages, are attained by the present invention which may be described briefly as a garment hanger shoulder guard a garment hanger shoulder guard for manipulation between a collapsed configuration, wherein the shoulder guard is essentially flattened for shipping and storage, and an erect configuration for placement upon a garment hanger to provide a desired garment-supporting contour configuration for a garment to be supported by the garment hanger, the garment hanger having a generally central altitudinally extending suspension hook, longitudinally spaced apart opposite end portions, and shoulder portions extending longitudinally and sloping altitudinally between the suspension hook and the opposite end portions for hanging the garment to be supported by the garment hanger, the shoulder guard comprising: an elongate member having a length extending in a longitudinal direction between opposite ends, and a generally central portion having a first lateral width extending in a lateral direction between opposite side edges, the longitudinal length being much greater than the lateral width; an aperture in the elongate member, the aperture being located generally centrally between the opposite ends and the opposite side edges for receiving the suspension hook of the garment hanger; the elongate member including intermediate shoulder support portions located between the central portion and each of the opposite ends, each shoulder support portion having a second lateral width greater than the first lateral width such that each shoulder support portion extends laterally beyond a corresponding side edge of the central portion; and a coupling member at each of the opposite ends for coupling the opposite ends to corresponding opposite end portions of the garment hanger, each coupling member including: an end wall at a corresponding end of the elongate member, the end wall being movable selectively between a collapsed position, wherein the end wall is placed essentially flat against the elongate member, and an erect position, wherein the end wall extends altitudinally from the elongate member for being coupled with the garment hanger; a slot in the end wall, the slot passing longitudinally through the end wall and extending altitudinally for receiving a corresponding end portion of the garment hanger and gripping the corresponding end portion to couple the elongate member to the garment hanger when the coupling member is erect; and laterally opposite gussets connecting the end wall with corresponding shoulder support portions, the gussets extending from the end wall laterally outwardly beyond the first lateral width toward the second lateral width, the gussets coupling the end wall with the shoulder support portions such that the gussets and the end wall lie essentially flat against the elongate member when the end wall is in the collapsed position, thereby placing the shoulder guard in the collapsed configuration and, upon movement of the end wall toward the erect position, the shoulder guard is placed in the erect configuration, with the shoulder support portions and the gussets coacting so as to bend the shoulder support portions into the desired garment-supporting contour configuration while biasing the end wall toward the collapsed position for facilitating retention of the coupling member securely coupled with the corresponding end portion of the garment hanger and further, upon hanging the garment over the shoulder guard, urging the end wall toward the erect position to maintain the desired garment-supporting contour configuration.

The invention will be understood more fully, while still further objects and advantages will become apparent, in the following detailed description of preferred embodiments of the invention illustrated in the accompanying drawing, in which.

Figure 1:
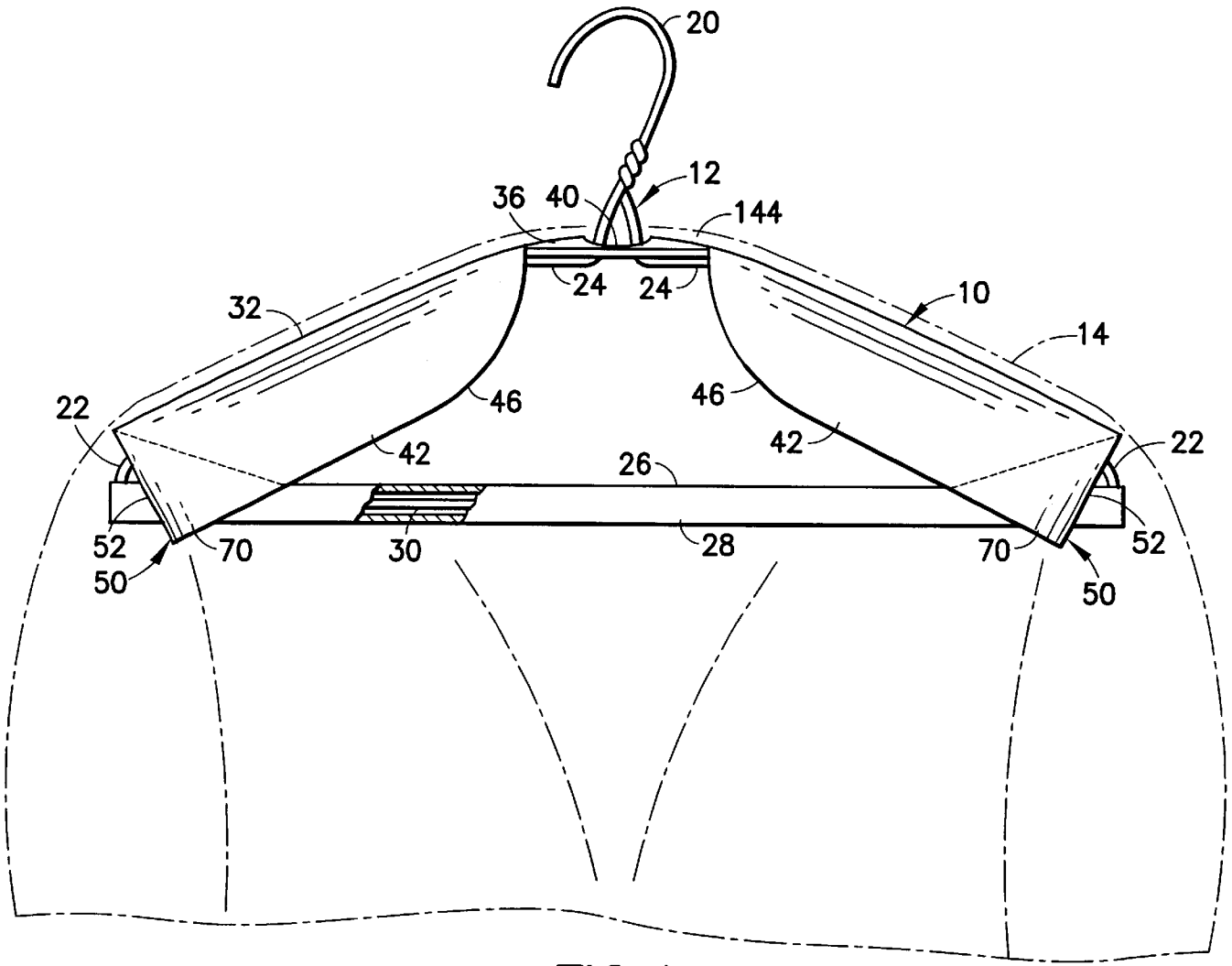
FIG. 1 is a front elevational view showing a shoulder guard constructed in accordance with the present invention, erected and assembled with a garment hanger upon which a garment is to be hung.

Referring now to the drawing, and especially to FIG. 1 thereof, a shoulder guard constructed in accordance with the present invention is illustrated generally at 10 and is seen to be erected and assembled with a garment hanger 12 upon which a garment, in the form of jacket 14, is to be hung for storage or for transportation. Garment hanger 12 is a typical wire hanger currently in use and is seen to include a generally central suspension hook 20 which extends in an altitudinal direction, longitudinally spaced apart opposite end portions 22, and shoulder portions 24 extending longitudinally and sloping altitudinally downwardly between the suspension hook 20 and the opposite end portions 22, all constructed of wire. Hanger 12 further is provided with a cross-bar 26 which extends longitudinally between the opposite end portions 22, altitudinally below the suspension hook 20 and which carries a cylindrical tube 28 having a diameter considerably larger than the wire core 30 of cross-bar 26.

Figure 2:
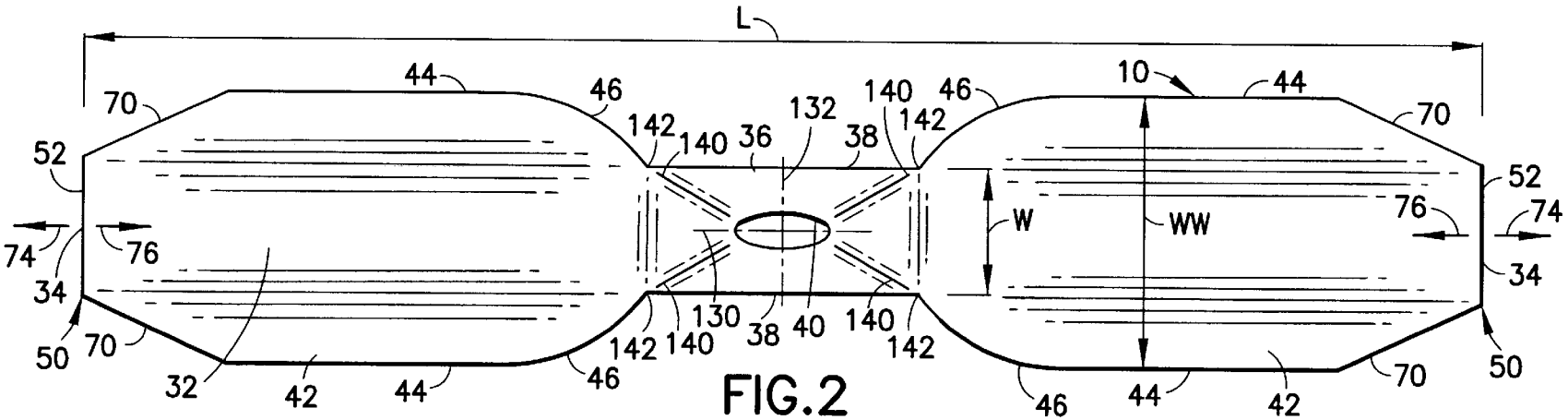
FIG. 2 is a top plan view of the shoulder guard in the erected configuration.
Figure 3:
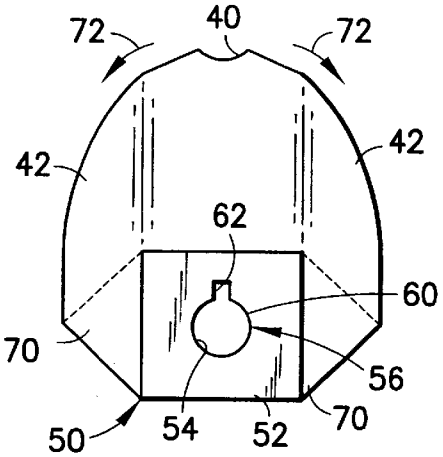
FIG. 3 is an end elevational view of the shoulder guard in the erected configuration.
Figure 4:
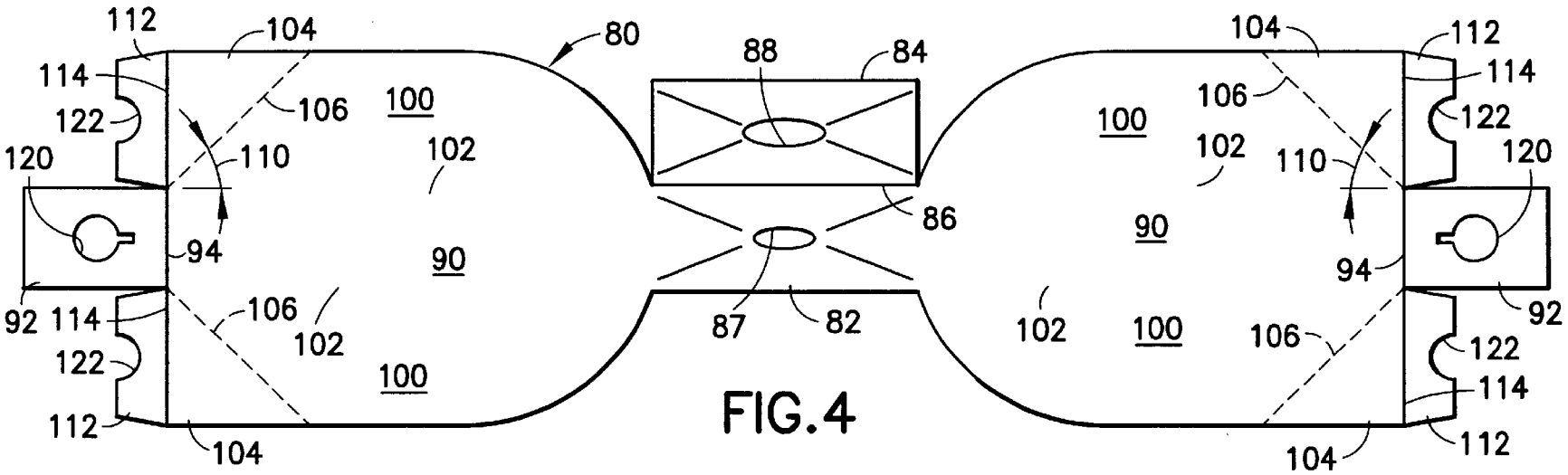
FIG. 4 is a top plan view of a blank from which the shoulder guard is to be constructed.

Turning now to FIGS. 2 and 3, as well as to FIG. 1, shoulder guard 10 is seen to include an elongate member 32 having a length L extending in a longitudinal direction between opposite ends 34, and a generally central portion 36 having a first lateral width W extending in a lateral direction between opposite side edges 38, the longitudinal length L being much greater than the lateral width W. In a typical shoulder guard 10, the longitudinal length L is about twenty-two inches, while the first lateral width W is about one and one-half inches. An aperture 40 is located generally centrally between the opposite ends 34 and the opposite side edges 38, and passes through the central portion 36 of the elongate member 32 for receiving the suspension hook 20 of the garment hanger 12.

The elongate member 32 includes intermediate shoulder support portions 42 located between the central portion 36 and each of the opposite ends 34. Each shoulder support portion 42 has a second lateral width WW extending in the lateral direction between opposite further side edges 44, the second lateral width WW being greater than the first lateral width W such that each shoulder support portion 42 extends laterally beyond a corresponding side edge 38 of the central portion 36. Shoulder support portions 42 include arcuate sections at 46 so as to eliminate sharp outlines which could crease, or at least show through, a garment hung over the shoulder guard 10. In this manner, the shoulder support portions 42 are provided with an extended area made available for supporting jacket 14 against unwanted distortion.

A coupling member 50 at each of the opposite ends 34 of the shoulder guard 10 couples the opposite ends 34 to respective opposite end portions 22 of the garment hanger 12. Each coupling member 50 includes an end wall 52 and a slot 54 in the end wall 52. In the erect configuration of the shoulder guard 10 each end wall 52 is in an erect position, as illustrated in FIGS. 1 through 3, with each end wall 52 extending altitudinally downwardly from the elongate member 32, and slot 54 passes longitudinally through end wall 52 for receiving a corresponding end portion 22 of the garment hanger 12 and gripping the corresponding end portion 22 to couple the elongate member 32 to the garment hanger 12 when the coupling member 50 is erect, as shown. To that end, slot 54 includes a profile configuration 56 essentially complementary to the corresponding configuration of the end portion 22. In the illustrated embodiment, slot 54 includes a generally circular portion 60 for receiving the cylindrical tube 28 of the cross-bar 26 at each end portion 22 in a gripping engagement, and a slit portion 62 extending altitudinally from the circular portion 60 for receiving wire portion 64 at the end portion 22 of the garment hanger 12.

Laterally opposite gussets 70 connect each end wall 52 with corresponding shoulder support portions 42, the gussets 70 extending from end wall 52 laterally outwardly beyond the first lateral width W toward the second lateral width WW. Gussets 70 are generally triangular and couple each end wall 52 with corresponding shoulder support portions 42 such that the shoulder support portions 42 and the gussets 70 coact to bend the shoulder support portions 42 in the direction of arrows 72 in FIG. 3, in response to movement of the end wall 52 in the direction of arrow 74 in FIG. 2. By virtue of the resilient characteristics of the material of the shoulder guard 10, such bending of the shoulder support portions 42 biases the end wall 52 in the direction of arrow 76 in FIG. 2, thereby facilitating retention of the coupling member 50 in securely coupled engagement with the corresponding end portion 22 of the garment hanger 12. Additionally, biasing of end walls 52 into engagement with end portions 22 compensates for any slight variations in dimensions and configuration in garment hangers encountered in the field.

Referring now to FIGS. 4 through 7, as well as to FIGS. 1 through 3, shoulder guard 10 is constructed from a blank 80 of a relatively inexpensive and expendable material having a resilience and durability commensurate with the performance required for the shoulder guard 10. A preferred material is card stock, of the type commonly used for shoulder guards. Blank 80 extends in a longitudinal direction corresponding to the longitudinal direction in which the length of the shoulder guard 10 extends, and includes a central area 82 corresponding to the central portion 36 of the shoulder guard 10. A reinforcing member in the form of a reinforcing flap 84 is unitary with the central area 82 along a central portion fold line 86 which extends in the longitudinal direction to become coincident with a corresponding side edge 38. A first aperture 87 is punched into the central area 82, and a counterpart aperture 88 is punched into the reinforcing flap 84 so that upon folding the reinforcing flap 84 under and against the underside of central area 82 the apertures 87 and 88 are registered to establish aperture 40 in the completed shoulder guard 10. Preferably, aperture 88 is slightly larger than aperture 87 so that any slight misalignment between the apertures 87 and 88 will not affect the size and position of the completed aperture 40.

Elongate areas 90 correspond to portions of the elongate member 32 which extend between the central portion 36 and the end walls 52, and end areas 92 correspond to end walls 52. Each end area 92 is unitary with a corresponding elongate area 90 along a fold line 94 extending laterally across the blank 80, the fold line 94 preferably being established by a score line. Shoulder support areas 100 correspond to shoulder support portions 42 and include longitudinal bend areas 102. Gusset areas 104 correspond to gussets 70 and are unitary with shoulder support areas 100 along fold lines 106 which extend at an acute angle 110 to the longitudinal direction to establish a generally triangular area corresponding to the triangular configuration of each gusset 70. A flap 112 is unitary with each gusset area 104 along a laterally extending fold line 114, the laterally extending fold lines 114 preferably being in the form of score lines. Each end area 92 includes an opening 120 punched from the end area 92 and having a configuration corresponding to the configuration of slot 54. Each flap 112 is provided with a notch 122 for purposes to be described below.

Shoulder guard 10 is erected from blank 80 as follows: Reinforcing flap 84 is folded about fold line 86 to juxtapose the reinforcing flap 84 with the underside of the central area 82. With the reinforcing flap 84 registered with the central area 82, the reinforcing flap 84 is secured to the central area 82, as with an adhesive, to establish the central portion 36 of the shoulder guard 10, reinforced against excessive deflections in altitudinal directions when supporting the weight of the garment draped over the shoulder guard 10. Folding and registration of the reinforcing flap 84 with the central area 82 is facilitated by constructing the fold line 86 in the form of a perforated line. The gusset areas 104 are folded about fold lines 106 into juxtaposition with the underside of the elongate areas 90 and the shoulder support areas 100, and the end areas 92 are folded along fold lines 94 into juxtaposition with the flaps 112 which extend from the gusset areas 104, bringing each opening 120 into registration with corresponding notches 122 in flaps 112. The end areas 92 then are secured to the flaps 112, as with an adhesive, to establish the end walls 52 and complete the shoulder guard 10, placed in a collapsed configuration illustrated in FIGS. 5 and 6. Fold lines 106 preferably are in the form of perforated lines to facilitate folding of the gusset areas 104 into juxtaposition with the underside of elongate areas 90.

Figure 5:
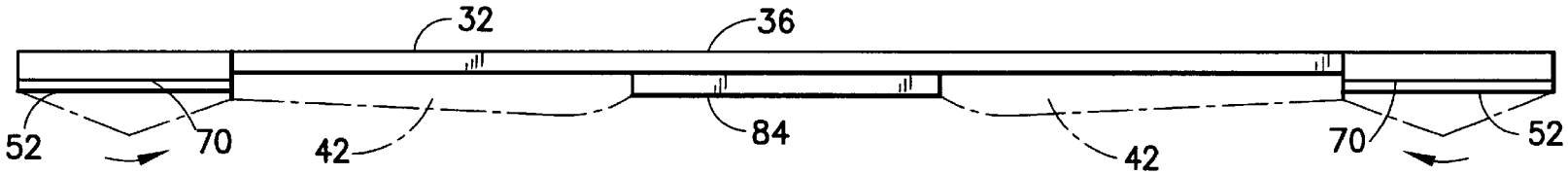
FIG. 5 is a front elevational view of the shoulder guard being completed and placed in a collapsed configuration.
Figure 6:
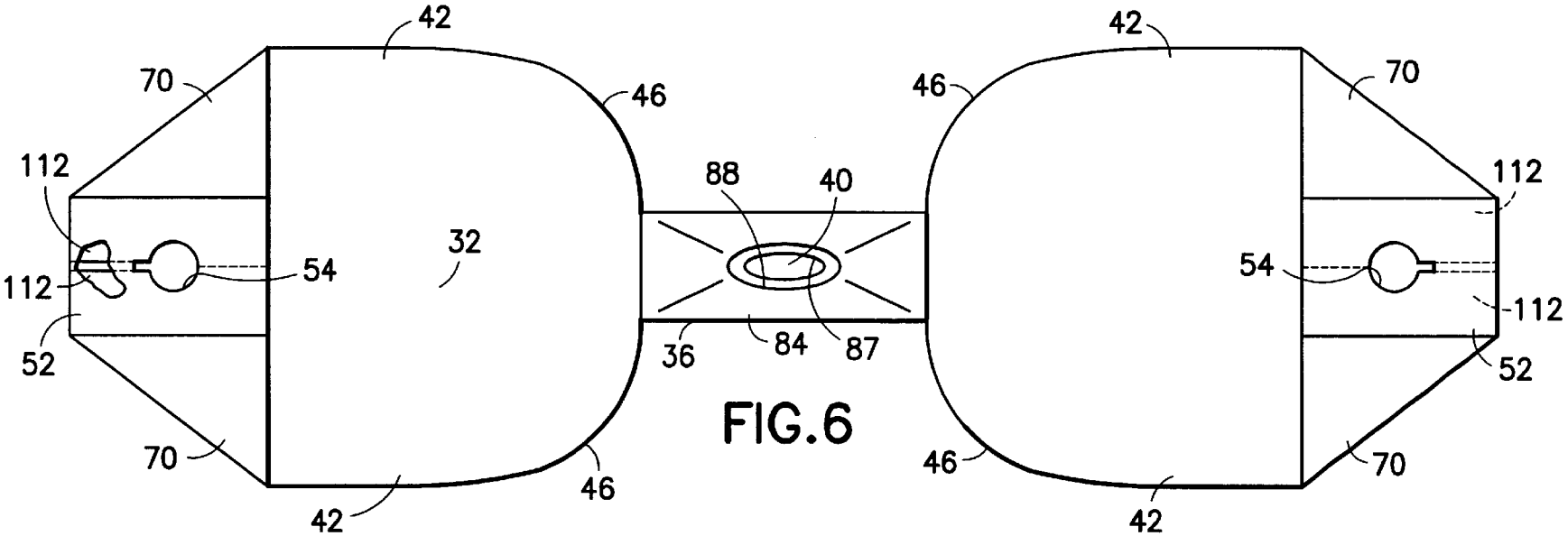
FIG. 6 is a bottom plan view of the shoulder guard in the collapsed configuration.
Figure 7:
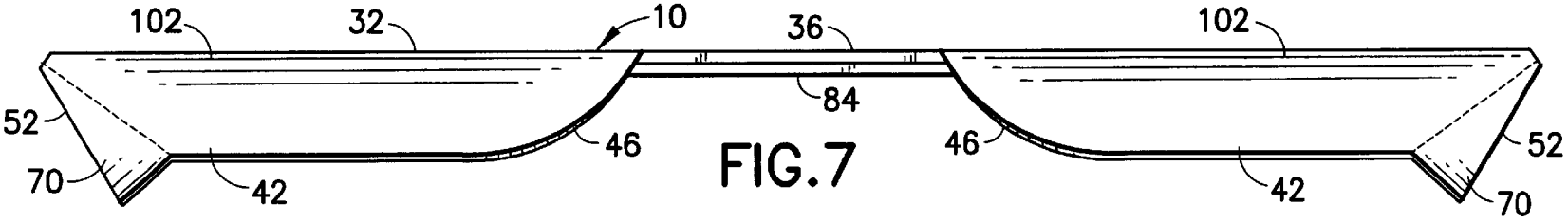
FIG. 7 is a front elevational view of the shoulder guard being placed in the erected configuration.

In order to erect the shoulder guard 10 into the erect configuration, as shown in FIG. 7, and place the shoulder guard 10 over the garment hanger, as illustrated in FIG. 1, the end walls 52 are manipulated so as to be moved from the collapsed position shown in FIGS. 5 and 6, to the erect position shown in FIG. 7. The suspension hook 28 of the garment hanger 12 is threaded through the aperture 40, the shoulder portions 24 are juxtaposed with the elongate member 32 of the shoulder guard 10 and the end portions 22 are engaged with the slots 54 in the end walls 52. By virtue of the connection provided by the gussets 70 between the end walls 52 and the shoulder support portions 42, movement of the end walls 52 from the collapsed position toward the erect position draws the shoulder support portions 42 altitudinally downwardly, bending the shoulder support portions 42 at bend areas 102 into a desired garment-supporting contour configuration for supporting a garment against unwanted distortion, as illustrated by the support of jacket 14 in FIG. 1, and for placement of the shoulder support portions 42 into a draped arrangement over the shoulder portions 24 of the garment hanger 12. At the same time, the resilient characteristics of the material of the shoulder guard 10 biases the end walls 52 back toward the collapsed position so that the coupling members 50 are securely coupled with the end portions 22 of the garment hanger, as shown in FIG. 1. The biasing mechanism is enhanced by the degree of flexibility provided at the perforated fold lines 106 and by the resilient spring-like characteristics provided by the score lines which establish fold lines 94 and 114.

In the preferred embodiment, the central portion 36 of the shoulder guard 10 is reinforced by the reinforcing flap 84 and the aperture 40 is of a fixed and limited size so as to preclude shifting of the shoulder guard 10 on the garment hanger 12 in longitudinal directions. Aperture 40 preferably has an elliptical configuration, including a major axis 130 and a minor axis 132 (see FIG. 2). The aperture 40 is oriented with the major axis 130 aligned with the longitudinal direction, while the minor axis 132 is aligned with the lateral direction. In this manner, the width of aperture 40, in the lateral direction, is limited so as to maintain the integrity of the central portion 36 while the length of aperture 40 provides sufficient clearance for threading the suspension hook 20 of the garment hanger 12 through the aperture 40 and proper seating of the shoulder guard 10 upon the garment hanger 12. At the same time, longitudinal shifting of the shoulder guard 10 on the garment hanger 12 is deterred.

In the collapsed configuration illustrated in FIGS. 5 and 6, shoulder guard 10 is complete, but is fully flattened for compact shipping and storage. When being readied for use, the shoulder guard 10 need merely be erected, as discussed in connection with FIG. 7, with no supplemental construction operations, such as on-site stapling or manual interlocking of a tab-and-slot assembly, being necessary to establish a fully erect, functional shoulder guard. In the erect configuration, the shoulder guard 10 provides contoured surfaces for supporting a garment in such a manner as to avoid wrinkling, creasing or other unwanted distortion. Once a garment is hung over the shoulder guard 10, as illustrated in FIG. 1, the weight of the garment, as exerted upon the shoulder support portions 42, urges the shoulder guard 10 into the erect configuration, by virtue of the coaction among the gussets 70, the shoulder portions 42 and the end walls 52, thereby maintaining the shoulder portions 42 in the desired garment-supporting contour configuration. Central portion 36 preferably includes central score lines 140 which extend between the aperture 40 and intersections 142 located where the opposite side edges 38 intersect the shoulder support portions 42. Central score lines 140 preferably are in the form of cut scores which do not extend completely through the material of the shoulder guard 10 and which do not extend all the way to the aperture 40 or to the intersections 142. Central score lines 140 allow the central portion 36 to be contoured for a better fit along collar sections of the garment hung on the garment hanger 12, as shown at 144 in FIG. 1.

Further, a smooth transition at the bend areas 102 of the shoulder support portions 42 is accomplished by merely bending the material of the shoulder guard 10 along the bend areas 102. However, in order to facilitate the shaping of such a smooth transition, one or more longitudinally extending score lines 146 may be provided along each bend area 102, as illustrated in the alternate embodiment of FIG. 8. In the preferred construction, score lines 146 are in the form of discontinuous, or "skip" scores, for better control of the bending along bend areas 102.

Figure 8:
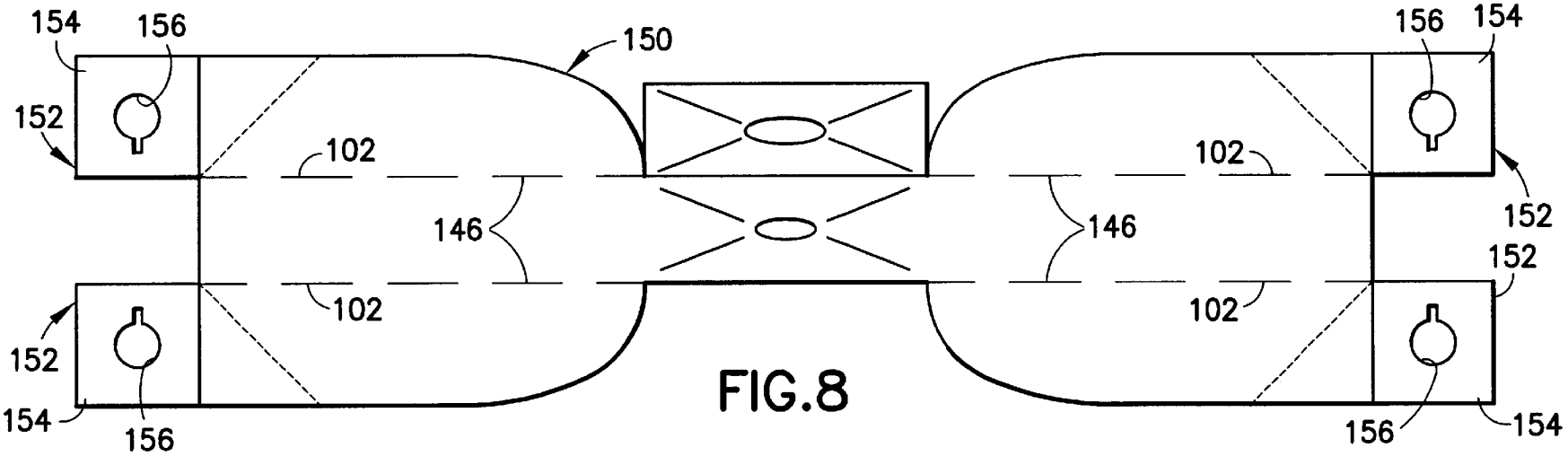
FIG. 8 is a top plan view of a blank from which another embodiment of the shoulder guard is to be constructed.

In the construction illustrated in FIG. 8, a shoulder guard blank 150 provides an alternate end walls 152 formed by overlapping flaps 154, each of which flaps 154 includes a slot 156 having a configuration for engaging an end portion 22 of the garment hanger 12. In the fully erected shoulder guard formed from blank 150, the flaps 154 are overlapped with one another and are secured together to establish the end walls 152.

It will be seen that the present invention attains the several objects and advantages summarized above, namely: Enables increased economy through the use of minimal amounts of material and less waste, as a result of an overall configuration which allows such economical construction; allows economical storage and transportation in a flattened condition with ease of erection and assembly with a garment hanger at the site of use; resists inadvertent removal from a garment hanger, once assembled, so as to provide exemplary performance during both storage and transport of the garment hung on the garment hanger; accommodates variations in dimensions and configuration of garment hangers encountered in the field without sacrificing performance; enables quick and simple erection and assembly at the site of use; provides increased versatility, with economy and exemplary performance in the preservation of desired contours in garments hung on garment hangers.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A garment hanger shoulder guard for manipulation between a collapsed configuration, wherein the shoulder guard is essentially flattened for shipping and storage, and an erect configuration for placement upon a garment hanger to provide a desired garment-supporting contour configuration for a garment to be supported by the garment hanger, the garment hanger having a generally central altitudinally extending suspension hook, longitudinally spaced apart opposite end portions, and shoulder portions extending longitudinally and sloping altitudinally between the suspension hook and the opposite end portions for hanging the garment to be supported by the garment hanger, the shoulder guard comprising:

an elongate member having a length extending in a longitudinal direction between opposite ends, and a generally central portion having a first lateral width extending in a lateral direction between opposite side edges, the longitudinal length being much greater than the lateral width;

an aperture in the elongate member, the aperture being located generally centrally between the opposite ends and the opposite side edges for receiving the suspension hook of the garment hanger;

the elongate member including intermediate shoulder support portions located between the central portion and each of the opposite ends, each shoulder support portion having a second lateral width greater than the first lateral width such that each shoulder support portion extends laterally beyond a corresponding side edge of the central portion; and a coupling member at each of the opposite ends for coupling the opposite ends to corresponding opposite end portions of the garment hanger, each coupling member including:

an end wall at a corresponding end of the elongate member, the end wall being movable selectively between a collapsed position, wherein the end wall is placed essentially flat against the elongate member, and an erect position, wherein the end wall extends altitudinally from the elongate member for being coupled with the garment hanger;

a slot in the end wall, the slot passing longitudinally through the end wall and extending altitudinally for receiving a corresponding end portion of the garment hanger and gripping the corresponding end portion to couple the elongate member to the garment hanger when the coupling member is erect; and laterally opposite gussets connecting the end wall with corresponding shoulder support portions, the gussets extending from the end wall laterally outwardly beyond the first lateral width toward the second lateral width, the gussets coupling the end wall with the shoulder support portions such that the gussets and the end wall lie essentially flat against the elongate member when the end wall is in the collapsed position, thereby placing the shoulder guard in the collapsed configuration and, upon movement of the end wall toward the erect position, the shoulder guard is placed in the erect configuration, with the shoulder support portions and the gussets coacting so as to bend the shoulder support portions into the desired garment-supporting contour configuration while biasing the end wall toward the collapsed position for facilitating retention of the coupling member securely coupled with the corresponding end portion of the garment hanger and further, upon hanging the garment over the shoulder guard, urging the end wall toward the erect position to maintain the desired garment-supporting contour configuration.

2. The invention of claim 1 wherein the end wall is integral with the elongate member along a first fold line extending laterally across the elongate member, between the opposite side edges, at a corresponding end of the elongate member and is folded along the first fold line for movement between the erect position and the collapsed position.

3. The invention of claim 2 wherein each gusset is integral with a corresponding shoulder support portion along a second fold line extending from a corresponding side edge at an acute angle to the longitudinal direction.

4. The invention of claim 3 wherein the second fold line is constructed to facilitate folding of the gusset essentially flat against the elongate member.

5. The invention of claim 4 wherein the second fold line comprises a perforated line.

6. The invention of claim 5 including a flap integral with each gusset along a third fold line extending in the lateral direction, the flap being secured to the end wall for movement with the end wall between the collapsed position and the erect position, the third fold line having a construction for facilitating biasing of the end wall toward the collapsed position.

7. The invention of claim 6 wherein the third fold line comprises a score line.

8. The invention of claim 1 including a reinforcing member integral with the central portion for reinforcing the central portion against excessive deflection in an altitudinal direction.

9. The invention of claim 8 wherein the reinforcing member includes a reinforcing flap integral with the central portion along a central portion fold line extending along one of the opposite side edges for folding of the reinforcing flap into juxtaposition with the central portion.

10. The invention of claim 8 wherein the aperture has a length extending along the longitudinal direction and a width extending along the lateral direction, the length of the aperture being greater than the width of the aperture.

11. The invention of claim 10 wherein the aperture has an elliptical configuration including a major axis aligned with the longitudinal direction and a minor axis aligned with the lateral direction.

12. The invention of claim 1 wherein the central portion intersects the shoulder support portions at intersections located at the opposite side edges between the central portion and the shoulder support portions, the central portion including central score lines extending from the aperture toward the intersections so as to facilitate flexing of the central portion to conform the central portion to the contours of the garment to be supported by the garment hanger.

13. The invention of claim 12 including a reinforcing member integral with the central portion for reinforcing the central portion against excessive deflection in an altitudinal direction.

14. The invention of claim 13 wherein the reinforcing member includes a reinforcing flap integral with the central portion along a central portion fold line extending along one of the opposite side edges for folding of the reinforcing flap into juxtaposition with the central portion.

15. The invention of claim 14 wherein the aperture has a length extending along the longitudinal direction and a width extending along the lateral direction, the length of the aperture being greater than the width of the aperture.

16. The invention of claim 15 wherein the aperture has an elliptical configuration including a major axis aligned with the longitudinal direction and a minor axis aligned with the lateral direction.

17. The invention of claim 1 wherein the shoulder support portions include bend areas for facilitating bending of the shoulder support portions into the desired garment-supporting contour configuration.

18. The invention of claim 17 including score lines extending in the longitudinal direction along the bend areas for facilitating shaping of the garment-supporting contour configuration.

19. The invention of claim 18 wherein the score lines comprise skip scores.

* * * * *